United States Patent [19]

Keller

[11] Patent Number: 4,834,268

[45] Date of Patent: May 30, 1989

[54] DISPENSING CARTRIDGE WITH DELIVERY PISTON

[76] Inventor: Wilhelm A. Keller, Riedstrasse 1, CH-6330 Cham, Switzerland

[21] Appl. No.: 155,295

[22] Filed: Feb. 12, 1988

[30] Foreign Application Priority Data

Feb. 13, 1987 [CH] Switzerland ..... 555/87

[51] Int. Cl.[4] ..... B65D 88/54

[52] U.S. Cl. ..... 222/327; 222/389

[58] Field of Search ..... 222/326, 327, 386, 386.5, 222/391; 220/93

[56] References Cited

U.S. PATENT DOCUMENTS

| | | | |
|---|---|---|---|
| 2,933,221 | 4/1960 | Rand et al. | 222/327 X |
| 3,029,985 | 4/1962 | Krueger et al. | 222/327 |
| 3,752,367 | 8/1973 | Sundholm | 222/256 |
| 4,022,355 | 5/1977 | Sabaka | 222/327 |
| 4,452,370 | 6/1984 | Langensiepen et al. | 220/93 |
| 4,645,098 | 2/1987 | Hoffman | 222/386 |

FOREIGN PATENT DOCUMENTS

| | | |
|---|---|---|
| 1263356 | 5/1961 | France . |
| 2097755 | 3/1972 | France . |

*Primary Examiner*—Michael S. Huppert
*Attorney, Agent, or Firm*—Darby & Darby

[57] ABSTRACT

In dispensing cartridges with a plunger-actuated delivery piston, the afterflow of cartridge content through the outlet, which typically occurs after each advance step of the delivery piston, is prevented. This usually occurs in double cartridges for two-component substances, in which a connected flow mixer causes high outflow resistance and correspondingly high pressure inside the cartridge during dispensing; concomitant "breathing" of the thin-walled cartridge cylinder is recognized as the primary cause of uncontrolled afterflow. The delivery piston of the invention is built with a sealing ring which is elastically deformable when acted upon by plunger force, in order to permit the delivery piston to recede in the direction opposite to the advance direction when the stress on the plunger is removed. Due to the axial volume expansion connected to it, the internal pressure can be reduced immediately after the stress is removed from the piston before the cartridge content shows afterflow through the outlet. In addition, through temporary squeezing during each advance, the sealing ring can be increasingly pressed against the cylinder wall in order to increase the sealing effect; in the unstressed resting position, pressing and hence the piston friction is far less and only the practically pressure-less cartridge content is to be sealed.

7 Claims, 1 Drawing Sheet

DISPENSING CARTRIDGE WITH DELIVERY PISTON

FIELD OF THE INVENTION

The invention relates to a dispensing cartridge with at least one reservoir cylinder and one delivery piston directed in it consisting of a piston barrel made up of a piston head and piston wall, as well as a sealing element sliding along the cylinder wall and intended for stepwise advance by a dispensing plunger, with parts of the piston barrel being elastically deformable through the action of the plunger.

BACKGROUND OF THE PRIOR ART

Dispensing cartridges of this nature serve in known manner for holding and processing pasty substances or those having medium to low viscosity, which upon the action on the delivery piston are driven out through the cartridge outlet. When working with such cartridges, one difficulty encountered is that the content tends to continue to flow after the action of the dispensing plunger on the delivery piston has ceased. This phenomenon is undesirable and irksome, since it prevents working neatly and does not permit precisely apportioned dispensing of small quantities. This continued flow is primarily due to the reservoir cylinder of the cartridge (most frequently built as a thin-walled disposable item of synthetic material), which, when dispensing, "breathes". That is, the cylinder is elastically expanded from the inside under the pressure of the cartridge content during piston advance and, upon cessation of the dispensing pressure, again assumes its starting shape. The delivery piston, however, due to the considerable sealing friction against the cylinder wall comes to a standstill. These phenomena are particularly marked and disturbing in so-called double cartridges for two-component substances like adhesive or sealing agents, etc., with flow mixers connected to the cartridge outlet. In such cartridges, due to the presence of the mixer, the outflow resistance offered the substances and, consequently, the pressure inside the cartridge required for dispensing is especially high. This, consequently, requires relatively high pressure of the piston sealing against the cylinder wall as well as correspondingly high plunger forces on the delivery pistons.

In French Pat. No. 1 263 356, a dispensing cartridge of the above-mentioned kind is disclosed, where, on the single-piece delivery piston, the piston head is arched toward the dispensing plunger and the sealing is formed by the cylindrical piston wall. During each plunger advance, the piston head is flattened by which an increased sealing effect is to be achieved due to the radial expansion of the piston wall; in addition, the piston head becomes arched again after completion of the plunger stroke, so that afterflow of the cartridge content is supposed to be avoided. Here, however, the volumetric change, which can be brought about by the deformation of the piston head alone, is very limited and, particularly when the cartridge is still full, is hardly sufficient to compensate for the "breathing" and to prevent afterflow completely. A further disadvantage is that a radial form change of the piston wall cannot be controlled through the mentioned effect of the piston head to the extent that, given the existing production tolerances, complete sealing of the piston is ensured during the advance as well as in the resting state. If the latter is to be achieved here, a high degree of piston friction inevitably occurs.

In another known dispensing cartridge of the mentioned kind (French Pat. No. 2, 097 755) for the single-piece delivery piston, the piston head is arched toward the cartridge content; at the outer edge of the piston head, a sealing lip is integrally attached, and the piston wall rests at a distance from the sealing lip slidingly movable against the cartridge wall. The purpose of this piston design is prevention of air enclosures when closing the filled cartridge. On dispensing the cartridge content during each plunger advance, the piston head is elastically deformed between the plunger disk and the content, i.e., it is partially flattened, in order to press the sealing lip during advance radially against the cartridge wall and subsequently, with the piston head unstressed and returned to original form to be lifted again; in the resting state, sealing is then effected solely through the above mentioned piston wall section. Preventing continued flow (afterflow) of the cartridge content in this design is neither intended nor possible, on the contrary, the afterflow is increased in that the piston head arches back against the cartridge content and, in so doing, decreases the available cartridge volume.

The task of the present invention consists in effectively preventing, through suitable design of the dispensing cartridge, in particular of the delivery piston, uncontrolled afterflow of the cartridge content after each partial dispensing and simultaneously keeping the piston friction at a minimum without sacrificing sealing in the stressed as well as in the unstressed state.

SUMMARY OF THE INVENTION

This problem is solved according to the invention in that a sealing ring is placed into an annular groove adjoining the rigid piston head and the annular groove cross-section is deformable, thereby, squeezing the sealing ring in order to permit the delivery piston to recede in the direction opposite to the direction of advance when the plunger is not under thrust. This results in that, every time immediately following cessation of the piston thrust, the pressure inside the cartridge, due to sufficient axial volume expansion through the receding piston, decreases completely before the cartridge content can flow through the outlet. With the solution suggested by the invention, therefore, the "breathing" of the cartridge as such is not prevented (as might be done possibly through increased wall thickness or other expensive reinforcement of the cartridge cylinder), but its undesirable after-effects are eliminated in a very simple manner. The unopposed receding of the entire delivery piston is facilitated by the actually low friction of the elastic sealing ring in the unstressed state while simultaneously ensuring sealing. Moreover, precise calculation of the extent of cross-section deformation (squeezing) of the sealing ring between stressed (advance) and unstressed state through predetermined local deformation of the annular groove is possible.

Actuation of the dispensing plunger (or plungers) can basically be manual; customarily, however, special dispensing devices can be provided with, for example, dispensing plunger(s) driven forward mechanically or pneumatically. For such device, it has been already suggested (EP-A No. 0 252 401 of the same inventor, which corresponds to U.S. Ser. No. 7/070,033), to bring the dispensing plunger(s) rapidly and automatically back by a given measure after each advance step and to lift the delivery piston off the cartridge in order to achieve instantaneous pressure relief of the cartridge.

Particular models of the invention, which differ in the design of the delivery piston, are described and claimed herein. The invention can, of course, be applied equally well to single as well as double cartridges or even to multiple cartridges.

For a better understanding of the present invention, reference is made to the following description and accompanying drawings, while the scope of the present invention will be pointed out in the appended claims.

BRIEF DESCRIPTION OF THE DRAWINGS

Different embodiments of the invention are described below in greater detail in conjunction with FIGS. 1, 2 and 3 of the drawing. In each instance, the dispensing cartridge with delivery piston as well as the associated dispensing plunger is represented in longitudinal section; for the sake of simplicity, however, in FIGS. 2 and 3, the cylinder wall 3 of the cartridge is only indicated with dash-dot lines. In all figures, the top half in each instance shows the unstressed state with the plunge resting, while the bottom half shows the condition during an advance step with elastic deformation of the delivery piston and the sealing ring; from the comparative juxtaposition on the same level, the particular deformation is readily apparent.

DESCRIPTION OF THE PREFERRED EMBODIMENTS

Figure 1:
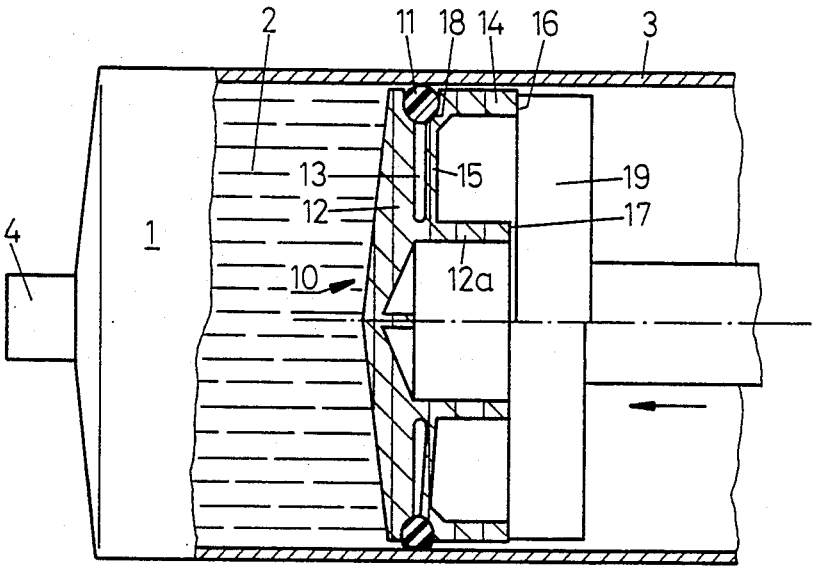

The dispensing cartridge 1 according to FIG. 1 has a reservoir cylinder 3 with outlet 4 and a delivery piston 10 directed in the cylinder. A plunger 19 of a dispensing device functions to push the delivery piston 10 stepwise forward against the cartridge outlet 4 in order to press the cartridge content 2 out through outlet 4. The piston barrel of the delivery piston 10 formed by the rigid piston head 12 and piston wall 14 is provided with sealing elements sliding along the cylinder wall 3 and, in particular, in the form of an elastic sealing ring 11 (so-called O-ring), which is placed into an annular groove 18 adjoining the piston head 12.

Of the two lateral slopes of grooves 18, one is formed on the piston head 12 and the other on the piston wall 14. The base of the groove is separated by a radial fissure 13. This is bounded on the plunger side by an elastic diaphragm 15, which connects the piston wall 14 with the piston head 12 in its central region. By axially displacing the piston wall 14 against the piston head 12, therefore, the piston barrel is elastically deformable, with the groove slope formed on the piston wall being axially displaced and the cross-section of the annular groove being narrowed, squeezing the sealing ring.

The end face 16 of the piston wall 14 facing the plunger 19 forms a first supporting area for the plunger. A second supporting area is formed by the end face 17 of a support cylinder **12*a* integrally attached to the piston head 12, which end face in the undeformed state of the piston barrel is slightly set back compared to the first area 16 (top half of FIG. 1**).

At the beginning of the advance of the plunger 19 in the direction of the arrow (bottom half of FIG. 1), it initially pushes, with given counter-pressure of the cartridge content 2 on the piston head 12, by way of support 16, the piston wall 14 against the piston head, with the diaphragm 15 deforming, the groove 18 narrowing, and the ring 11 being squeezed. This deformation of the piston comes to an end as soon as the second support 17 becomes additionally effective on the plunger and subsequently the deformed piston as a whole is displaced. In this way, the two separate contact areas 16 and 17 ensure, on the one hand, a limited and precisely defined deformation of the piston barrel and consequently ring 11. On the other hand, during the advance, the plunger force is, by way of a second support 17, introduced directly into the rigid piston head. That means that the head 12 is braced on plunger 19 by way of area 17.

Narrowing of the annular groove 18 during the piston advance effects a corresponding cross-section deformation of the elastic sealing ring 11, which is pressed with increased force radially against the cylinder wall 3. By this, increased sealing effect is brought about during the advance, as is required in view of the markedly increased pressure of the cartridge content as well as the pressure-caused slight expansion of the cartridge. Primarily essential is, however, that the elastic deformation of the piston barrel and the sealing ring disappear again, i.e., the piston again assumes the starting shape (top half in FIG. 1) as soon as it reaches the end of an advance step of plunger 19, the stress is again removed respectively or, through an appropriately designed dispensing device, is lifted slightly from the delivery piston 10. With the pressure of the sealing ring 11 now low again, and correspondingly strongly reduced piston friction against the cylinder 3, the entire piston 10 recedes immediately under the internal pressure of the cartridge content before the content can afterflow through outlet 4; concomitantly, a distention of the cylinder, which occurred previously under the pressure increase, is reduced again.

The requisite pressing of the sealing ring 18 (as well as the sealing elements in the embodiments described below) on the cartridge cylinder in the unstressed undeformed state of the delivery piston is comparatively low because only the practically pressure-less cartridge content must be sealed during storage and during the intervals between the advance steps; this circumstance permits sufficient recession of the piston toward the plunger, intended by the invention, when the plunger is unstressed. Because the piston head 12 is rigid and, further, the particular deformation of the piston barrel is precisely defined, an exact correlation exists between the plunger stroke and the volume carried out through the cartridge outlet 4; this is particularly important with two-component systems, which are dispensed from double cartridges, in that, there, the precise volumetric ratio of the two quantities dispensed per plunger stroke from the two cartridge cylinders is critical.

The radial fissure 13 must not necessarily, as shown in FIG. 1, be symmetrical to the two lateral slopes of the annular groove 18. Rather, it can also (deviating somewhat from FIG. 1) be displaced toward a lateral slope, so that, for example, a planar transition to the lateral wall of fissure 13 is given.

Figure 2:
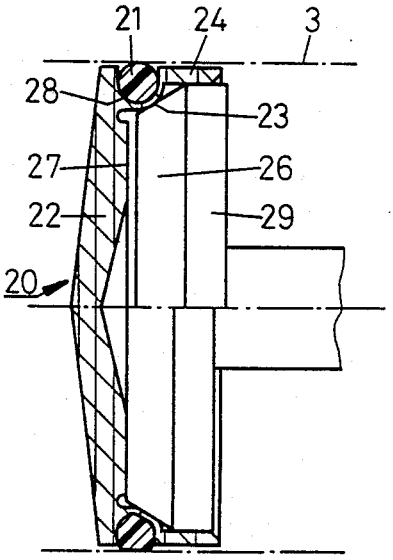

In the following examples, the recession of the delivery piston is achieved in each instance subsequent to an advance step through different design of the piston or through different elastic deformation of the annular groove cross-section; the delivery piston 20 according to FIG. 2 provided with piston head 22 and piston wall 24 likewise has an annular groove 28 into which a sealing ring 21 is placed. The base 23 of groove 28, which connects the piston wall 24 in one piece with the rigid piston head 22, is thin-walled and correspondingly deformable; opposite it on the inside is a conical section 26 of the dispensing plunger 29. The base 23 of groove 28 forms a first support region during the initial plunger advance and is deformed by the plunger section 26 while narrowing the groove cross-section and correspondingly squeezing ring 21. The deformation is complete as soon as the plunger end face encounters support area 27 located on the piston head 22. By way of this additional support, the forward stroke of the deformed delivery piston (bottom half in FIG. 2), with increased pressure of sealing ring 21, takes place. At the completion of the advance, with the stress on plunger 29 removed and it being brought back slightly, the deformation of the base of the groove and the ring disappears immediately, which causes the piston 20 to recede and afterflowing of the cartridge content to be avoided.

Figure 3:
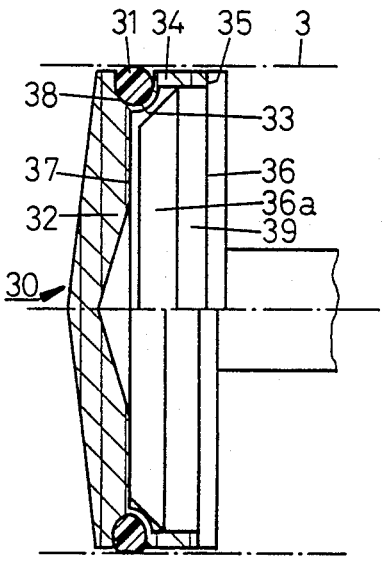

In the delivery piston 30 according to FIG. 3, piston head 32, piston wall 34, annular groove 38 and sealing ring 31 are formed similar to the example according to FIG. 2. Here, however, as in FIG. 1, narrowing of the groove cross-section and squeezing of ring 31 takes place through axial displacement of the one slope of the groove formed on the piston wall 34, in that the face 35 of the piston wall opposes a contact area on the plunger 39 and forms a first support area for it. A support area 37 on the piston head is in contact with the plunger only when the piston is deformed during the advance and forms an additional support area limiting the piston deformation. A conical (or one formed corresponding to the groove base 33) plunger section **36*a*** can, during the advance, support the groove base radially. The mechanism of function of this model is easily recognized after the preceding explanation.

It may be surprising in the described embodiments that the groove cross-sections have unusual shapes and the sealing ring is subjected to deformations which are generally considered by conventional mechanical and apparatus engineering to be unreliable for long-term operation. Here, however unconventional, additional design possibilities are deliberately utilized, which are presented by the circumstance that such dispensing cartridges are disposable products, the components of which only need to tolerate a few functions. Nevertheless, with the measures according to the invention, the striven-for effect and high degree of functioning certainty during the short use can be achieved. By the fact that the elastic deformation of the groove cross-section caused by the plunger entrains also a radial expansion of the sealing ring, the piston sealing, while maintaining sufficient pressure, follows the expanding "breathing" cartridge wall so that, during the advance, secure sealing is also maintained.

While the foregoing description and drawings represent the preferred embodiments of the present invention, it will be obvious to those skilled in the art that various changes and modifications may be made therein without departing from the true spirit and scope of the present invention.

What is claimed is:

1. A dispensing cartridge comprising:

a reservoir cylinder having an inner wall and an outlet nozzle;

a delivery piston having an annular sealing means, said piston slidably engaging said inner wall of said cylinder by action of said annular sealing means;

said delivery piston adapted to being responsive to variable thrust providable by intermittent actuation of a dispensing plunger so as to cause said delivery piston to be advanced in a step-wise manner for allowing apportioned dispensing of contents of the cartridge through said outlet nozzle;

said delivery piston including a rigid piston head, a substantially cylindrical piston wall and an annular groove therebetween defined by a first groove wall portion in said piston head and a second groove wall portion in said piston wall, said annular sealing means disposed in said annular groove; and said first and second groove wall portions being elastically deformable so that the groove in cross-section will be changed in response to the variable thrust applied to said dispensing plunger so as to squeeze said sealing means within the groove during piston advance and to release said sealing means when thrust is removed from the dispensing plunger to permit the delivery piston to recede in a direction opposite to the direction of the applied thrust.

2. A dispensing cartridge as stated in claim 1, wherein the piston wall is axially displaceable relative to the piston head.

3. A dispensing cartridge as stated in claim 2, wherein the piston wall is connected with the piston head by way of a diaphragm which is separated from the piston head by a radial fissure.

4. A dispensing cartridge as stated in claim 2, wherein the annular groove has a base portion which is flexible and connects the piston wall with the piston head.

5. A dispensing cartridge as stated in claim 1, wherein the annular groove has a base portion which is deformable in a radial direction of said cylinder.

6. A dispensing cartridge as stated in claim 1, wherein the piston head forms a support area for the plunger limiting deformation of said groove wall portions.

7. A dispensing cartridge as stated in claim 1, wherein a support cylinder extending from the piston head forms a support area for the plunger limiting deformation of said groove wall portions.

* * * * *